US008307918B2

(12) United States Patent
Vandersnick et al.

(10) Patent No.: US 8,307,918 B2
(45) Date of Patent: Nov. 13, 2012

(54) HYDROCARBON RECOVERY DRILL STRING APPARATUS, SUBTERRANEAN HYDROCARBON RECOVERY DRILLING METHODS, AND SUBTERRANEAN HYDROCARBON RECOVERY METHODS

(75) Inventors: Greg Vandersnick, Sheridan, WY (US); Brian Landry, Sheridan, WY (US); Robb Vanpelt, Sheridan, WY (US)

(73) Assignee: New Era Petroleum, LLC, Sheridan, WY (US)

( * ) Notice: Subject to any disclaimer, the term of this patent is extended or adjusted under 35 U.S.C. 154(b) by 259 days.

(21) Appl. No.: 12/892,827

(22) Filed: Sep. 28, 2010

(65) Prior Publication Data

US 2011/0011574 A1 Jan. 20, 2011

Related U.S. Application Data

(62) Division of application No. 11/820,721, filed on Jun. 20, 2007, now Pat. No. 7,823,662.

(51) Int. Cl.
*E21B 21/015* (2006.01)

(52) U.S. Cl. ..... 175/195

(58) Field of Classification Search ..... 175/195, 175/207, 209, 211, 214
See application file for complete search history.

(56) References Cited

U.S. PATENT DOCUMENTS

| | | | |
|---|---|---|---|
| 1,634,235 | A | 6/1927 | Ranney |
| 1,634,236 | A | 6/1927 | Ranney |
| 1,660,818 | A | 2/1928 | Ranney |
| 1,667,269 | A | 4/1928 | Ranney |
| 1,722,679 | A | 7/1929 | Ranney |
| 1,811,560 | A | 6/1931 | Ranney |
| 1,811,561 | A | 6/1931 | Ranney |
| 1,812,305 | A | 6/1931 | Ranney |
| 1,842,098 | A | 1/1932 | Howard |
| 1,851,446 | A | 3/1932 | Ranney |
| 1,858,847 | A | 5/1932 | Young |
| 1,877,915 | A | 9/1932 | Lewis |
| 1,884,858 | A | 10/1932 | Ranney |
| 1,935,643 | A | 11/1933 | Laughlin |
| 2,331,072 | A | 10/1943 | Hansen et al. |
| 2,850,271 | A | 9/1958 | Dykstra |
| 2,989,294 | A | 6/1961 | Coker |
| 3,045,769 | A | 7/1962 | Feucht et al. |

(Continued)

FOREIGN PATENT DOCUMENTS

WO WO 2006/135744 12/2006

(Continued)

OTHER PUBLICATIONS

WO PCT/IB/2008/001857, Apr. 27, 2009, Search Report.

(Continued)

*Primary Examiner* — William P Neuder
(74) *Attorney, Agent, or Firm* — Wells St. John, P.S.

(57) ABSTRACT

Disclosed are hydrocarbon recovery drill string apparatus, subterranean hydrocarbon recovery drilling methods, and subterranean hydrocarbon recovery methods. In one embodiment, a hydrocarbon recovery drill string apparatus includes an elongated assembly within which a rotatable drill rod is received. The assembly comprises a longitudinal axis, a drill rod entrance end, and a drill rod exit end. The assembly comprises a tailcuttings diverter pipe proximate the drill rod exit end, with the tailcuttings diverter pipe defining an initial fluid flow path of the tailcuttings from the longitudinal axis which is acute from the longitudinal axis. Other apparatus and method aspects are contemplated.

11 Claims, 7 Drawing Sheets

U.S. PATENT DOCUMENTS

| | | | | |
|---|---|---|---|---|
| 3,285,352 | A | 11/1966 | Hunter | |
| 3,749,170 | A | 7/1973 | Riehl | |
| 3,785,402 | A | 1/1974 | Collier | |
| 3,820,605 | A | 6/1974 | Barber et al. | |
| 3,833,070 | A | 9/1974 | Anderson | |
| 3,866,697 | A | 2/1975 | Rossfelder et al. | |
| 3,934,935 | A | 1/1976 | Lambly et al. | |
| 4,047,760 | A | 9/1977 | Ridley | |
| 4,061,190 | A | 12/1977 | Bloomfield | |
| 4,101,172 | A | 7/1978 | Rabbitts | |
| 4,140,180 | A | 2/1979 | Bridges et al. | |
| 4,144,935 | A | 3/1979 | Bridges et al. | |
| 4,165,903 | A | 8/1979 | Cobbs | |
| 4,283,088 | A | 8/1981 | Tabakov et al. | |
| 4,378,949 | A | 4/1983 | Miller | |
| 4,381,124 | A | 4/1983 | Verty et al. | |
| 4,401,163 | A | 8/1983 | Elkins | |
| 4,423,907 | A | 1/1984 | Ridley | |
| 4,441,759 | A | 4/1984 | Hutchins et al. | |
| 4,444,433 | A | 4/1984 | Ricketts | |
| 4,458,757 | A | 7/1984 | Bock et al. | |
| 4,458,945 | A | 7/1984 | Ayler et al. | |
| 4,463,987 | A | 8/1984 | Berg et al. | |
| 4,483,398 | A | 11/1984 | Peters et al. | |
| 4,508,168 | A | 4/1985 | Heeren | |
| 4,524,826 | A | 6/1985 | Savage | |
| 4,595,239 | A | 6/1986 | Ayler et al. | |
| 4,607,888 | A | 8/1986 | Trent et al. | |
| 4,693,313 | A | 9/1987 | Stephenson et al. | |
| 4,811,741 | A | 3/1989 | Shell et al. | |
| 4,811,799 | A | 3/1989 | Blackwell et al. | |
| 4,852,666 | A | 8/1989 | Brunet et al. | |
| 5,040,601 | A | 8/1991 | Karlsson et al. | |
| 5,082,054 | A | 1/1992 | Kiamanesh | |
| 5,547,021 | A | 8/1996 | Raden | |
| 5,662,181 | A | 9/1997 | Williams et al. | |
| 6,001,333 | A | 12/1999 | See | |
| 6,149,345 | A | 11/2000 | Atkins | |
| 6,561,041 | B1 | 5/2003 | Eck | |
| 7,093,661 | B2 | 8/2006 | Olsen | |
| 7,543,649 | B2 | 6/2009 | Richter et al. | |
| 7,568,527 | B2 | 8/2009 | Richter et al. | |
| 7,823,662 | B2 * | 11/2010 | Vandersnick et al. | 175/195 |
| 2003/0089506 | A1 | 5/2003 | Ayler et al. | |
| 2006/0290197 | A1 | 12/2006 | See et al. | |
| 2007/0012450 | A1 | 1/2007 | Uttley | |

FOREIGN PATENT DOCUMENTS

| | | |
|---|---|---|
| WO | WO2006135744 | 12/2006 |
| WO | PCT/US2007/025696 | 5/2008 |
| WO | PCT/IB2008/001857 | 1/2010 |

OTHER PUBLICATIONS

WO PCT/IB/2008/001857, Apr. 27, 2009, Written Opinion.
WO PCT/US2007/025696, May 9, 2008, Written Opinion.
WO PCT/US2007/025696, May 9, 2008, Search Report.
WO PCT/US2007/025698, May 9, 2008, Written Opinion.
Bartis et al., "Oil Shale Development in the United States", RAND Infrastructure, Safety, and Environment, pp. 1-61, 2005.
Best et al., Underground Test Facility: Shaft and Tunnel Laboratory for Horizontal . . . , Society of Petroleum Engineers, 60th Annual Tech. Conf. and Exhibit, SPE 14333, 16 pages (Las Vegas, NV Sep. 22-25, 1985).
Cowan, 1928-1985: The Devran Gravity Assisted Drainage of Petroleum Project, Geology-Devonian, vol. 24, No. 12, Ontario Petroleum Institute Conference and Trade Show, pp. 1-7 (1986).
Dick et al., Oil Mining, 5 pages (pre-2006).
Lyman et al., Heavy Oil Mining Technical and Economic Analysis, Society of Petroleum Engineers, California Regional Meeting, SPE 12788, pp. 565-574 (Long Beach, CA Apr. 11-13, 1984).
Publication of TAM International titled, "Horizontal Jet Pump Testing with Jet Pump in Lateral," http://www.tamintl.com/pages/tech3j.htm, printed May 13, 2005, 1 pg.
Publication of TAM International titled, "Locating and Controlling Water Production in Horizontal Wells (Permian Basin)," http://www.tamintl.com/pages/tech3.htm, printed Oct. 27, 2006, 6 pgs.
Publication of TAM International titled, "McElroy Field Horizontal Well Case History No. 1, Crier McElroy 147, Fluid Entry Evaluation and Water Shut-off," http://www.tamintl.com/pages/tech3c.htm, printed Oct. 27, 2006, 1 pg.
Publication of TAM International titled, "McElroy Field Typical Horizontal Well Application (Figure 1)," http://www.tamintl.com/pages/tech3b.htm, printed Sep. 15, 2006, 1 pg.
Publication of TAM International titled, "Scab Liner and Bridge Plug," http://www.tamintl.com/pages/tech3g.htm, printed May 13, 2005, 1 pg.
Ranney, Horizontal Wells Are All in Pay—and Flow by Gravity, The Petroleum Engineer, pp. 127-130 (Aug. 1941).
Rice, Mining Petroleum by Underground Methods: A Study of Methods Used in France and Germany and Possible . . . , U.S. Department of Commerce, Bureau of Mines, Bulleting 351, pp. Title-159 (1932).
See, "Oil mining field test to start in East Texas", Gulf Publishing Company, 1996, 3 pages.
Stephenson, Underground mining and tunneling techniques for in-situ oil recovery, Tunnels & Tunnelling, pp. 41-46 (Sep. 1988).
Streeter et al., "Recovery of Oil From underground Drillsites", Society of Petroleum Engineers, Eastern Regional Meeting, SPE 19344, pp. 339-348 (Morgantown, WV Oct. 24-27, 1989).

* cited by examiner

HYDROCARBON RECOVERY DRILL STRING APPARATUS, SUBTERRANEAN HYDROCARBON RECOVERY DRILLING METHODS, AND SUBTERRANEAN HYDROCARBON RECOVERY METHODS

RELATED PATENT DATA

This patent resulted from a divisional application of U.S. patent application Ser. No. 11/820,721 filed Jun. 20, 2007, entitled "Hydrocarbon Recovery Drill String Apparatus, Subterranean Hydrocarbon Recovery Drilling Methods, and Subterranean Hydrocarbon Recovery Methods", naming Greg Vandersnick, Brian Landry, and Robb Vanpelt as inventors, the disclosure of which is incorporated by reference.

TECHNICAL FIELD

This invention relates to hydrocarbon recovery drill string apparatus, to subterranean hydrocarbon recovery drilling methods, and to subterranean hydrocarbon recovery methods.

BACKGROUND OF THE INVENTION

To recover oil or other hydrocarbons from underground, a hole commonly referred to as a well is drilled to within a deposit within which the oil or other hydrocarbon is retained. Such drilling occurs using a boring device called a bit which is pressed hard against the ground while turning. The bit is typically part of a cutting head that is screwed onto the end of a hollow pipe commonly referred to as drill rod or drill pipe. Rotational motion is imparted to the drill rod and correspondingly the cutting head having the bit connected to it. The rotating bit crunches into the rock and scrapes and gouges it out to make a well.

At the same time the bit is rotating, drilling fluid/mud is pumped inside the hollow drill rod, and out of the bit. The drilling fluid flows out around the bit and transports the removed material annularly about the drill rod and out of the bore hole/well being drilled.

The tailcuttings from the drilling are diverted away from the drill rod very close to where they exit the hole being drilled. When conducting down-hole drilling, or drilling downwardly at an angle, gravity effectively keeps the drilling mud from flowing to any significant degree upwardly along the drill rod past the point where the drilling mud is diverted away from the drill rod. However if the initial angle of drilling is horizontal or at some upward angle, for example as might occur in oil mining techniques, the drilling mud can fall/flow by gravity rearward along the drill rod past the desired point of diversion.

While the invention was motivated in addressing the above identified issues, it is in no way so limited. The invention is only limited by the accompanying claims as literally worded, without interpretative or other limiting reference to the specification, and in accordance with the doctrine of equivalents.

SUMMARY

This invention includes hydrocarbon recovery drill string apparatus, subterranean hydrocarbon recovery drilling methods, and subterranean hydrocarbon recovery methods. In one embodiment, a hydrocarbon recovery drill string apparatus includes an elongated assembly within which a rotatable drill rod is received. The assembly comprises a longitudinal axis, a drill rod entrance end, and a drill rod exit end. A tailcuttings diverter pipe is provided proximate the drill rod exit end, with such defining an initial fluid flow path of the tailcuttings from the longitudinal axis which is acute from the longitudinal axis.

In one embodiment, a hydrocarbon recovery drill string apparatus includes an elongated assembly within which a rotatable drill rod is received. The assembly comprises a brush construction received about the drill rod. The brush construction has a plurality of brush bristles extending radially inward in contact with the rotatable drill rod. In one embodiment, the assembly comprises a non-metallic drill rod retainer member encircling the drill rod adjacent the brush bristles downstream relative to tailcuttings flow of the brush bristles to limit radial drill rod movement adjacent the brush bristles.

In one embodiment, a hydrocarbon recovery drill string apparatus includes an elongated assembly within which a rotatable drill rod is received. The assembly comprises a rotating head apparatus which includes a male bearing spindle through which the drill rod is rotatably received. The male bearing spindle comprises threads, with such comprising a longitudinal outer surface. A female spindle receiver is also provided, and through which the drill rod is rotatably received. The female spindle receiver comprises threads which threadedly receive the male bearing spindle threads. The female spindle receiver threads comprise a longitudinal inner surface against which a non-metallic seal is received. The longitudinal outer surface of the male bearing spindle threads bear against the non-metallic seal. A rotatable head is received rotatably by and about the male bearing spindle. The drill rod is rotatable with the rotatable head.

In one embodiment, a hydrocarbon recovery drill string apparatus includes an elongated assembly within which a rotatable drill rod is received. The elongated assembly comprises a rotating head apparatus which includes a bearing spindle apparatus through which the drill rod is rotatably received. The bearing spindle apparatus comprises a radially extending surface portion having a non-metallic seal received thereagainst. A rotatable head assembly is received by and about the bearing spindle apparatus. The rotatable head assembly comprises a portion projecting radially inward that longitudinally bears against and rotates relative to the non-metallic seal. The drill rod is rotatable with the rotatable head.

In one embodiment, a subterranean hydrocarbon recovery drilling method includes, within a subterranean room, drilling into a hydrocarbon deposit at an initial angle which is from horizontal to upward vertical using an elongated assembly within which a rotating drill rod is received. The assembly comprises a longitudinal axis. Tailcuttings are flowed from the drilling within the assembly rearwardly along the longitudinal axis. Flow of the rearwardly flowing tailcuttings is diverted from the longitudinal axis through a diverter pipe having an initial fluid flow path from the longitudinal axis which is acute from the longitudinal axis. In one embodiment in a hydrocarbon recovery method, such drilling forms a well bore that extends into the hydrocarbon deposit from the subterranean room. After the drilling, the drill rod is removed from the well bore and hydrocarbon is flowed from the deposit into the subterranean room.

In one embodiment, a subterranean hydrocarbon recovery drilling method includes, within a subterranean room, drilling into a hydrocarbon deposit at an initial angle which is from horizontal to upward vertical using an elongated assembly within which a rotating drill rod is received. Tailcuttings from the drilling are flowed within the assembly rearwardly along the rotating drill rod. The rotating drill rod is contacted with brush bristles which encircle the rotating drill rod to block at least some of the rearwardly flowing tailcuttings from flowing rearwardly of the brush bristles along the rotating drill rod. In one embodiment in a hydrocarbon recovery method, such drilling forms a well bore that extends into the hydrocarbon deposit from the subterranean room. After the drilling, the drill rod is removed from the well bore and hydrocarbon is flowed from the deposit into the subterranean room.

Other aspects and implementations are contemplated.

BRIEF DESCRIPTION OF THE DRAWINGS

Preferred embodiments of the invention are described below with reference to the following accompanying drawings.

FIG. 5 is an enlarged view of still another portion of FIG. 1.

FIG. 7 is a diagrammatic partial sectional view of another drill string apparatus embodiment incorporating a number of different separate and collective inventive aspects.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Aspects of the invention include hydrocarbon recovery drill string apparatus, subterranean hydrocarbon recovery drilling methods, and subterranean hydrocarbon recovery methods. The various apparatus aspects of the invention are not limited by the method aspects, nor are the method aspects limited by the apparatus aspects. Yet aspects of the various methods may be accomplished utilizing some or all of the various different apparatus aspects disclosed herein.

Figure 1:
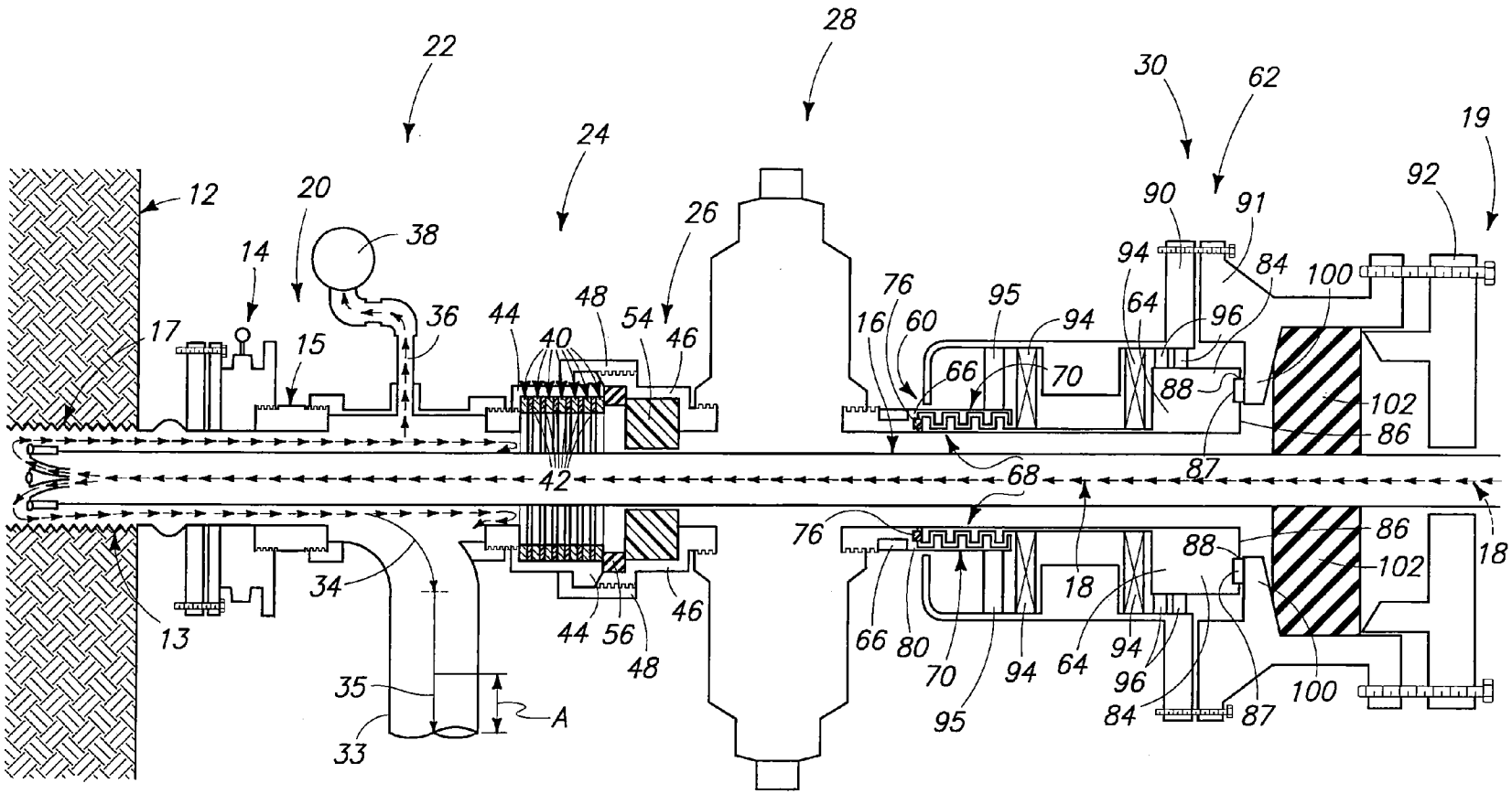
FIG. 1 is a diagrammatic partial sectional view of a drill string apparatus embodiment incorporating a number of different separate and collective inventive aspects.

Referring initially to FIG. 1, an example preferred embodiment hydrocarbon recovery drill string apparatus in accordance with multiple aspects of the invention is indicated generally with reference numeral 10. In the context of this document, "a hydrocarbon recovery drill string apparatus" is any drill string apparatus usable for drilling well bores into earthen material for the ultimate recovery of hydrocarbon products, such as crude oil, natural gas, etc., from such material. FIG. 1 depicts an earthen wall 12, for example of a mined-out subterranean room, and relative to which apparatus 10 is mounted. A bore hole 13 has been formed through earthen wall 12 into the earthen material. A flange and shutoff valve assembly 14 has been mounted relative to bore hole 13. Drill string apparatus 10 is connected to flange and shutoff valve assembly 14 via an opposingly threaded nipple 15. The above is exemplary only, and any alternate existing or yet-to-be developed arrangement is of course contemplated.

Drill string apparatus 10 is comprised of an elongated assembly within which a rotatable drill rod 16 is received. By way of example only, an example is a steel drill rod having an outer diameter of 2.75". Drill rod 16 is diagrammatically shown as having a suitable cutting head 17 mounted thereto, and defines an internal fluid passageway through which drilling fluid flows to the cutting head. The cutting head might also comprise or incorporate an auxiliary mud motor (not shown). The elongated assembly of drill string apparatus 10 can be considered in one embodiment as comprising a longitudinal axis 18 along which drill rod 16 is received, as well as a drill rod entrance end 19 and a drill rod exit end 20. The preferred embodiment elongated assembly of apparatus 10 is comprised of various subcomponents, certain aspects of which constitute separate independent invention regardless of other aspects of the elongated assembly. Regardless, the elongated assembly of apparatus 10 is depicted as comprising a tailcuttings diverter 22 received about drill rod 16, a brush construction 24 received about drill rod 16, a drill rod retainer 26 received about drill rod 16, a blowout preventer 28 received about drill rod 16, and a rotating head apparatus 30 received about drill rod 16.

Apparatus aspects of the invention were primarily motivated in contending in designing a drill string adapted for use in a subterranean room for drilling into a hydrocarbon deposit at some initial angle within the room which is somewhere from horizontal to upward vertical and within which a rotatable drill rod is received. One challenge associated with such is contending with tailcuttings from the drilling flowing into various components of the drill string apparatus. In aboveground down-hole, or in downwardly angled drilling, the tailcuttings flow is generally upward, thereby working against gravity. In such instances, the force of gravity works against flow of tailcuttings past a drilling mud diverter pipe of the drill string such that flow of tailcuttings rearwardly along the drill rod past a tailcuttings diverter pipe is largely precluded or at least minimal. However when drilling at an initial horizontal angle or at an upward angle, rearward flow of tailcuttings along the drill rod can be significant, leading to undesired premature failure of components of the drill string.

FIG. 1 depicts an example orientation of drill string apparatus 10 which is horizontal. The arrows traversing down along the longitudinal axis 18 of drill rod 16 depict example drilling fluid flow in the direction of well bore 13. Arrows pointing in the opposite direction circumferentially about drill rod 16 depict example tailcuttings flow away from working cutting head 17. Ideally, such rearwardly flowing tailcuttings flow away from drill string apparatus 10 by means of a preferred embodiment tailcuttings diverter 22 as described below. Nevertheless, in a horizontally or upwardly angled orientation of drill string apparatus 10, tailcuttings may flow rearwardly of diverter 22 along drill rod 16, and certain preferred embodiment aspects of drill string apparatus 10 are designed to reduce or minimize rearward tailcuttings flow beyond diverter 22, and/or contend with tailcuttings that might still undesirably flow rearwardly through and along drill string apparatus 10 past diverter 22.

Figure 2:
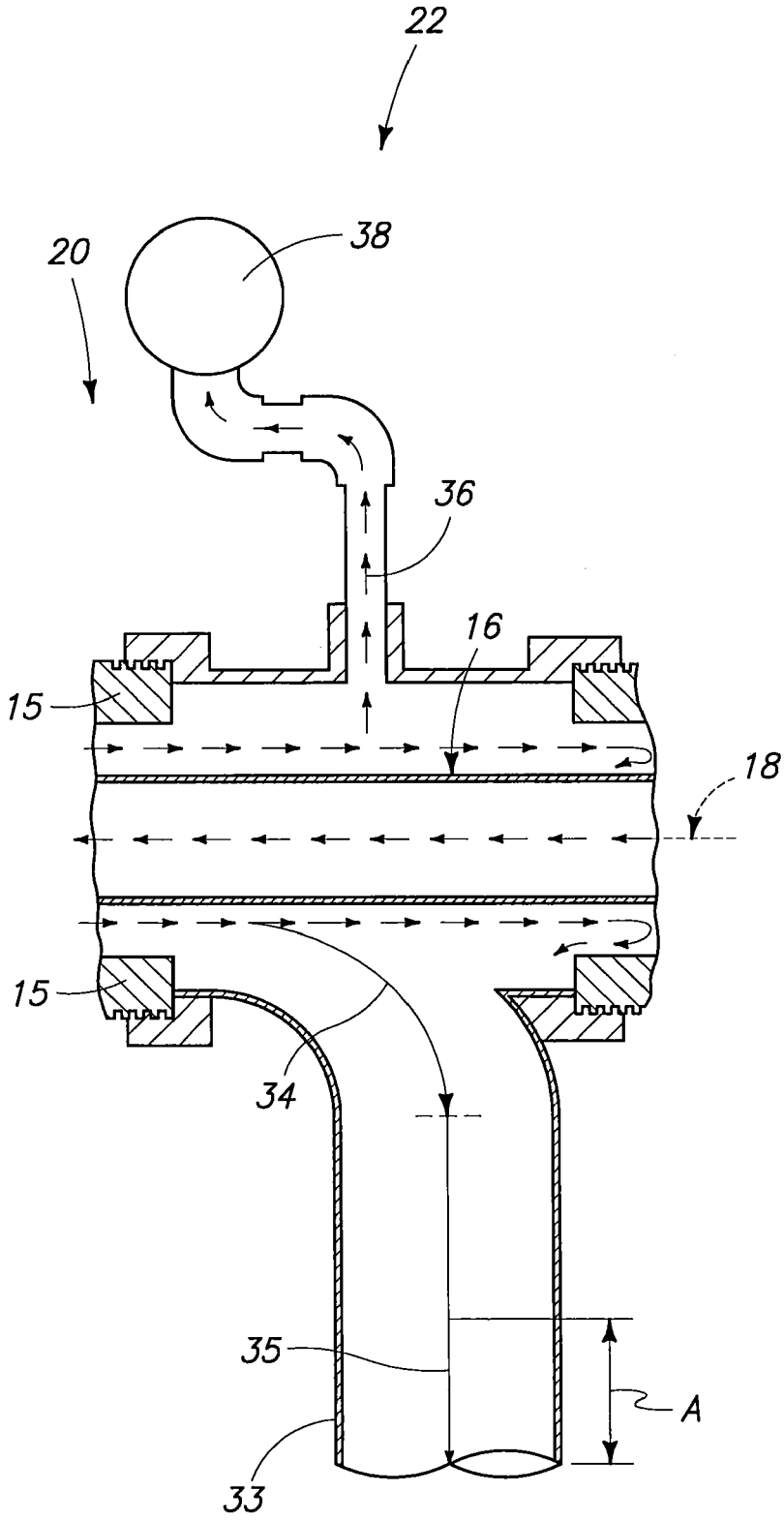
FIG. 2 is an enlarged view of a portion of FIG. 1.

Referring to FIGS. 1 and 2, tailcuttings diverter 22 comprises a tailcuttings diverter pipe 33 received proximate drill rod exit end 20 of the elongated assembly. In the context of this document, "proximate the drill rod exit end" only requires that the stated tailcuttings diverter pipe be closer to the drill rod exit end than to the drill rod entrance end. Tailcuttings diverter pipe 33 defines an initial fluid flow path 34 of the tailcuttings from longitudinal axis 18 which is acute from such longitudinal axis. Such acute initial fluid flow path 34 might be essentially initially along a straight line from longitudinal axis 18 (not shown) or might alternately, by way of example, define a curved initial fluid flow path (as shown). In one embodiment and as shown, initial fluid flow path 34 transitions to a fluid flow path 35 within diverter pipe 33 which extends 90° from longitudinal axis 18 along at least some straight length "A" of diverter pipe 33.

Tailcuttings diverter 22 includes an example conduit 36 opposite diverter pipe 33 which connects with a pressure gauge 38 for monitoring tailcuttings fluid pressure within tailcuttings diverter construction 22. Tailcuttings diverter 22 is depicted as threading to nipple 15 which threads to flange and shutoff valve assembly 14. Such is but one example embodiment of a manner by which apparatus 10 connects relative to earthen wall 12 for drilling.

Figure 3:
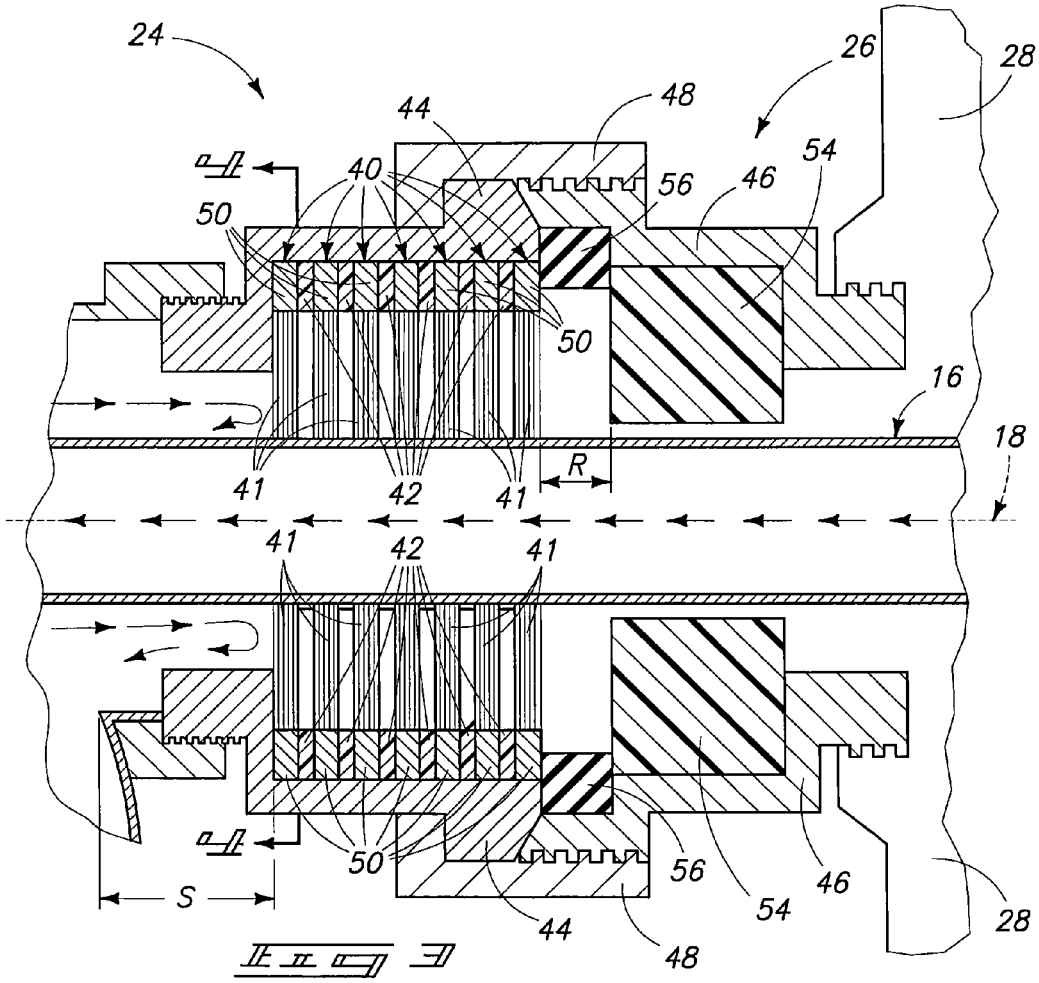
FIG. 3 is an enlarged view of another portion of FIG. 1.
Figure 4:
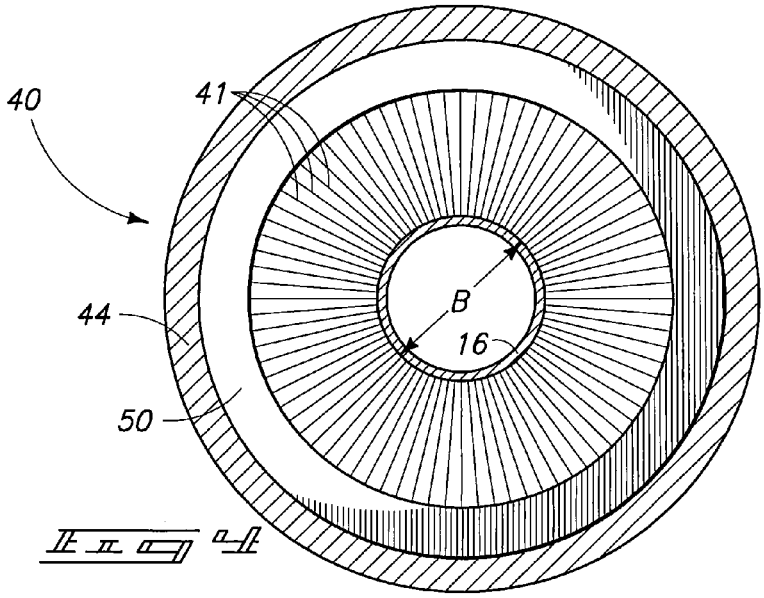
FIG. 4 is a diagrammatic sectional view taken through line 4-4 in FIG. 3.
Figure 4:
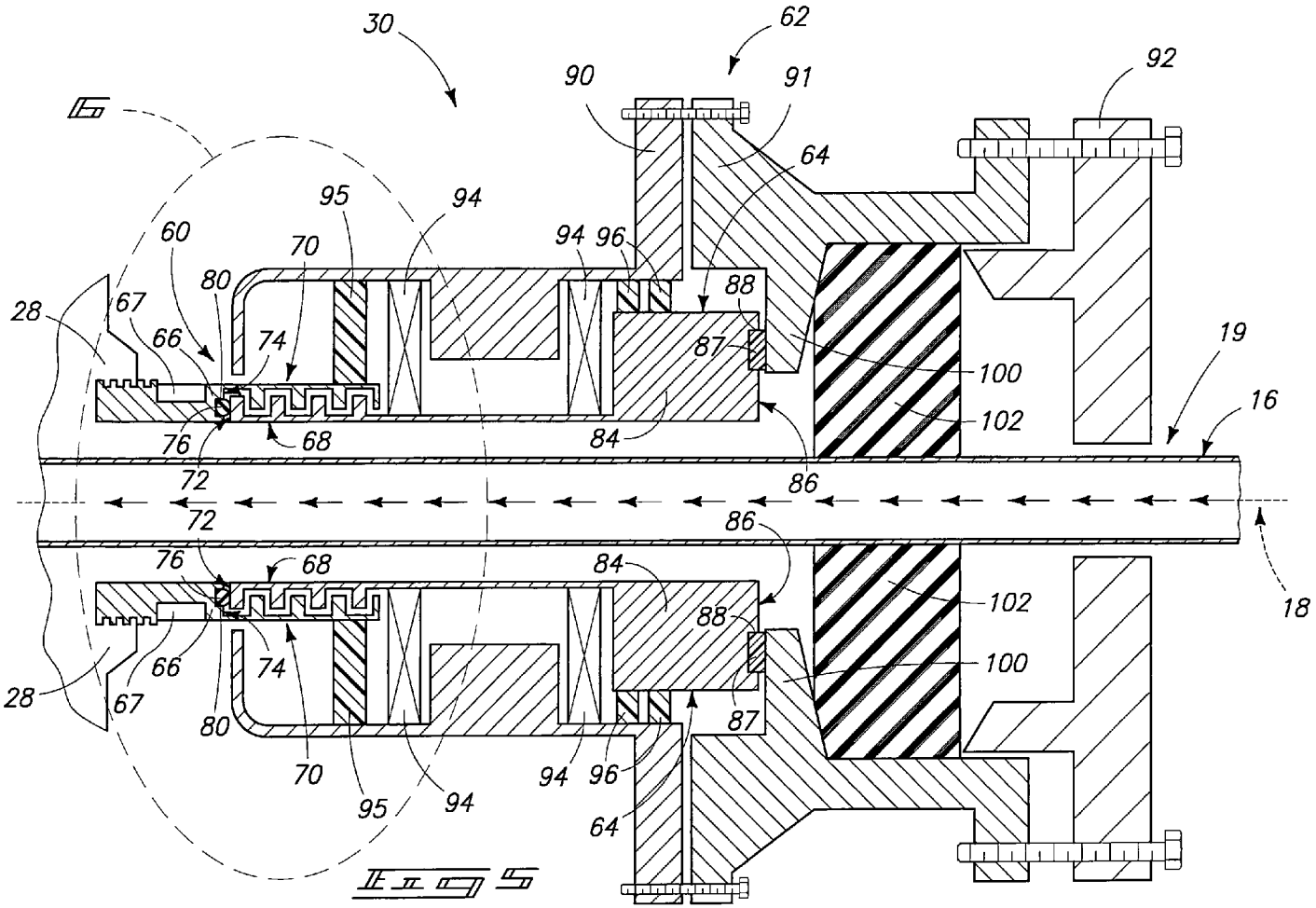

Referring to FIGS. 1, 3, and 4, brush construction 24 is received about drill rod 16, and includes a plurality of brush bristles (i.e., non-metallic, with polyurethanes and polystyrenes by way of example only being possible types of material) which extend radially inward into contact with the rotatable drill rod downstream relative to tailcuttings flow of where tailcuttings diverter pipe 33 is received. Brush construction 24 is non-rotating in operation. In one embodiment, the brush bristles comprise a plurality of rings 40 of brush bristles 41, with such rings being spaced from one another along longitudinal axis 18. However, aspects of the invention also contemplate a plurality of brush bristles extending radially inward in contact with the rotatable drill rod independent of any series or plurality of spaced rings of brush bristles. In one preferred embodiment, the plurality of rings of brush bristles number at least five, with seven rings 40 being shown by way of example only in FIGS. 1 and 3. A spacer ring 42 (preferably non-metallic, with polytetrafluoroethylene or other polymer(s) being examples) is received between adjacent pairs of spaced brush bristle rings 40, for example to facilitate spaced longitudinal alignment of the brush bristles relative one another. Accordingly by way of example only, six spacer rings 42 are shown in drill string apparatus 10.

In one embodiment, brush construction 24 comprises a housing 44 which encircles drill rod 16. In the depicted embodiment, housing 44 is one part of a three-part hammer union. Another part 46 of the hammer union, in one embodiment, comprises a drill rod retainer as will be explained in more detail below. Housing 44 and hammer union part/member 46 are retained tightly relative to one another by a third hammer union part in the form of an example nut 48. Housing 44 of the hammer union is depicted as threading relative to tailcuttings diverter 22, and part 46 threads relative to blowout preventer 28.

In one embodiment, the brush construction comprises at least one ring member to which the brush bristles connect and from which the brush bristles extend radially inward to rotatable drill rod 16. FIGS. 1, 3, and 4 depict one such preferred embodiment wherein each brush ring 40 comprises a ring member 50 to which brush bristles 41 connect and from which such extend radially inward to drill rod 16. Example suitable materials for ring member 50 include any metal. An example longitudinal thickness for ring members 50 is 5/16", with spacer rings 42 having an example longitudinal thickness of 1/8". In one preferred embodiment, ring members 50/rings 40 are removably received by brush housing 44, for example in one embodiment by being slidably received by brush housing 44 for insertion and removal along longitudinal axis 18. Accordingly upon excessive wear, the brush bristles can be removed and substitute rings of brush bristles reinserted into the brush housing 44 upon disassembly. By way of example only, an example outer diameter for ring member 50 is 5.0", and example brush bristles 41 extending therefrom extend inwardly to provide an inner diameter "B" of about 2.70" (7/8" length bristles), thereby contacting a drill rod 16 having an example outer diameter of 2.75". Cutting head 17 at the working end of drill rod 16 can be forced through brush bristles 41 at time of initial insertion. For example and by way of example only, an example cutting head 17 having a maximum outer diameter of 3.032" can be force slid through the above example brush bristles 41.

Brush bristles 41 of brush construction 24 are received downstream relative to tailcuttings flow of where tailcuttings diverter pipe 33 is received. In one embodiment, at least some of brush bristles 41 contact rotatable drill rod 16 along longitudinal axis 18 within 10" of tailcuttings divert pipe 33. For example, FIG. 3 depicts a dimension "S" of the closest of brush bristles 41 relative to tailcuttings diverter pipe 33. Such distance is preferably minimized to facilitate redirecting of tailcuttings into diverter pipe 33 from flowing rearwardly thereof relative to longitudinal axis 18. Preferably, dimension "S" is no greater than 5", and even more preferably no greater than 1".

Drill rod retainer 26, by way of example only and in but one embodiment, is comprised by hammer union member/part 46. Regardless, such includes some non-metallic drill rod retainer portion 54 which encircles drill rod 16 adjacent brush bristles 41 downstream relative to tailcuttings flow of brush bristles 41 to limit radially drill rod movement adjacent such brush bristles. In the context of this document, a non-metallic drill rod retainer portion is adjacent the brush bristles if the shortest longitudinal separation distance between the non-metallic retainer portion and closest brush bristles is no greater than 7". In preferred embodiments, a longitudinal separation distance "R" (FIG. 3) between the non-metallic retainer portion and the closest brush bristles thereto is no greater than 6", and in another preferred embodiment no greater that 2". By way of example only, example materials for drill rod retainer portion 54 are polytetraflouroethylene or other polymer. Drill rod retainer 54 might not be entirely non-metallic, but should include some non-metallic portion (s) which would be expected to come into contact with rotating drill rod 16 at some point, towards minimizing spark generation. An example outer diameter of retainer ring portion/member 54 in the context of the described preferred embodiment is 5.0" and an example inner diameter is 3.1", thereby enabling the example drill head 17 having a maximum outer diameter of 3.032" to be carefully slidable therethrough during assembly and disassembly. Non-metallic drill rod retainer portion 54 might be used to limit radially movement or degree of bending of drill rod 16 in operation, thereby perhaps keeping tighter radial alignment of drill rod 16 relative to brush bristles 41, thereby possibly reducing tendency of the brush bristles to wear.

Non-metallic drill rod retaining portion 54 is retained longitudinally relative to hammer union portion 46 at least in part by means of an elastomeric seal 56. Alternate manners of retention, whether existing or yet to be developed, might of course be used.

In one embodiment and as shown, blowout preventer 28 is received downstream relative to tailcuttings flow of non-metallic drill rod retainer portion 54. Use of a blowout preventer is preferred and likely required by mine safety regulations. Of course, any existing or yet-to-be developed blowout preventer 28 might be utilized. Such typically function by providing a tight seal against drill rod 16 when such is not rotating, and precludes fluid flow from the well bore rearwardly within the drill string apparatus when in a shut-down state. In the depicted embodiment, blowout preventer 28 is shown as threading relative to hammer union member 46 and a portion of rotating head apparatus 30.

Figure 6:
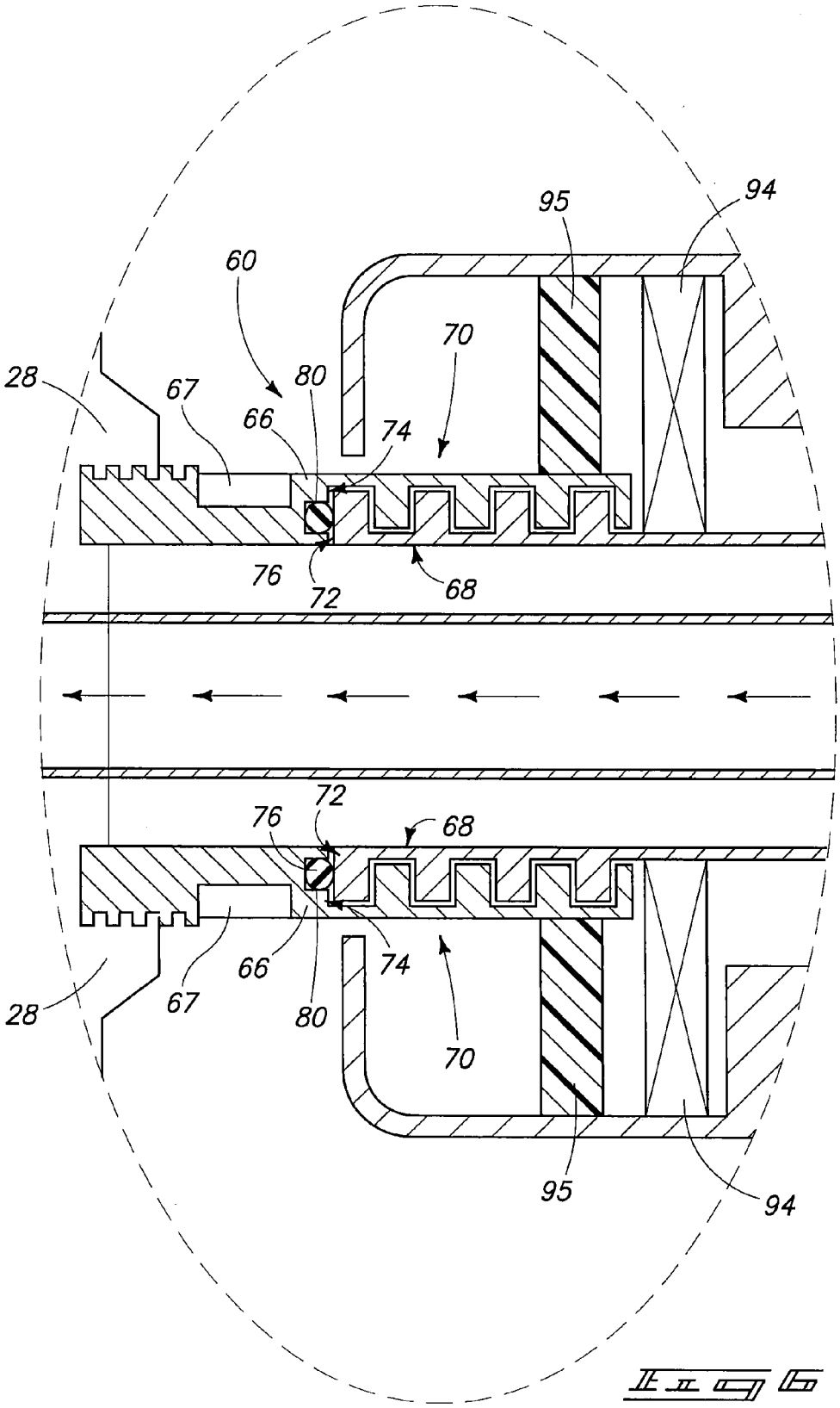
FIG. 6 is an enlarged view of a portion of FIG. 5.
Figure 11:
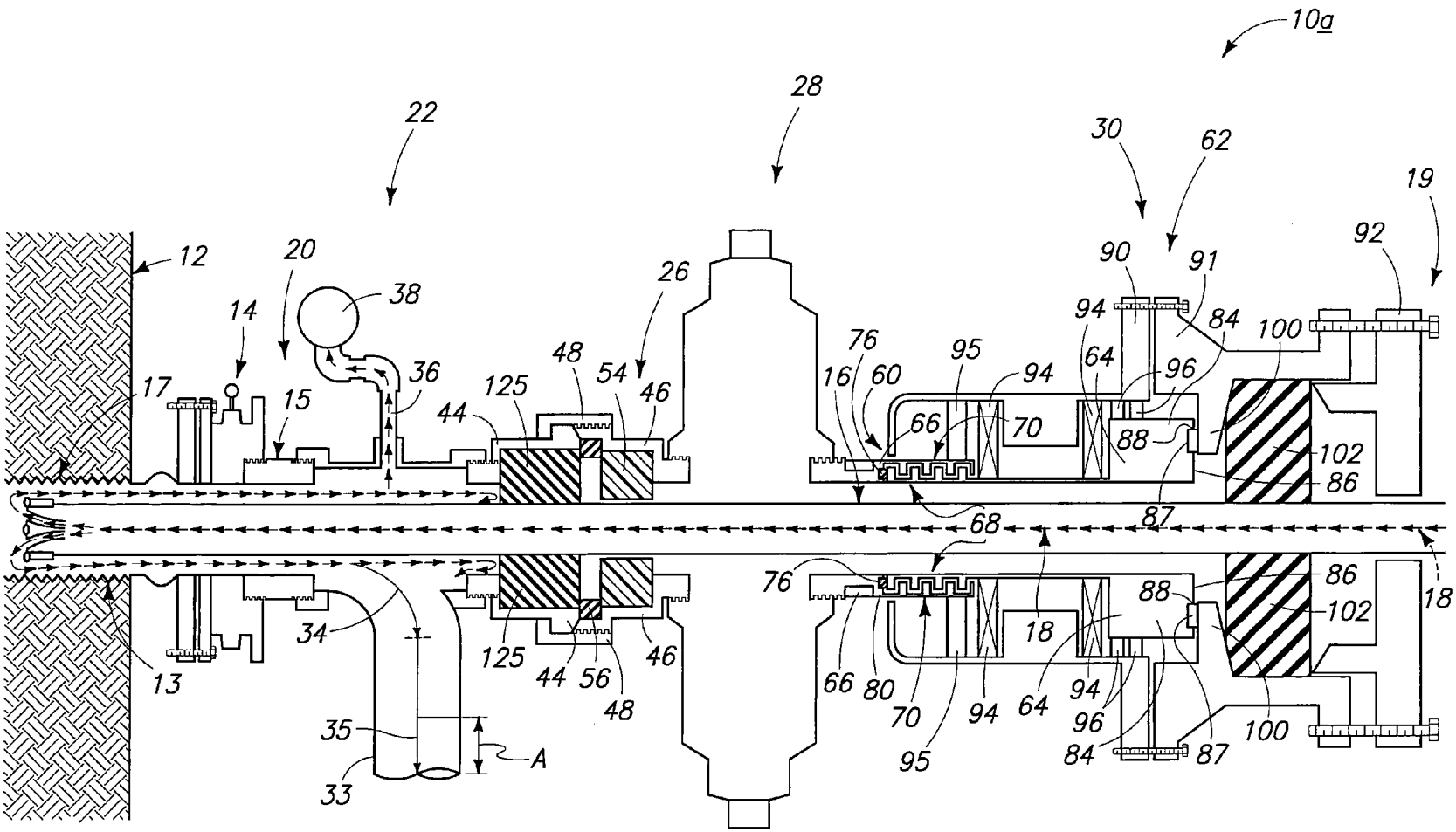

Referring to FIGS. 1, 5, and 6, rotating head apparatus 30 in one embodiment can be considered as comprising a bearing spindle apparatus 60 through which drill rod 16 is rotatably received and a rotatable head assembly 62 received by and about bearing spindle apparatus 60. In one embodiment, bearing spindle apparatus 60 comprises a male bearing spindle 64 and a female spindle receiver 66, with drill rod 16 being rotatably received through each. Female spindle receiver 66 is shown with example wrench flats 67. Further in the depicted example embodiment, female spindle receiver 66 threads relative to blowout preventer 28. Male bearing spindle 64 comprises threads 68, and female spindle receiver 66 comprises threads 70 which threadedly receive male bearing spindle threads 68. Male bearing spindle threads 68 include a longitudinal outer surface 72, and female spindle receiver threads 70 comprise a longitudinal inner surface 74. A non-metallic seal 76 is received against longitudinal inner surface 74 of female spindle receiver 66. In the depicted and preferred embodiment, non-metallic seal 76 comprises an O-ring, and in one preferred embodiment longitudinal inner surface 74 of female spindle receiver threads 70 comprises a groove 80 within which non-metallic seal 76 is received. Regardless, longitudinal outer surface 72 of male bearing spindle threads 68 bears against non-metallic seal 76.

Rotatable head 62 is received rotatably by and about male bearing spindle 64, for example and by way of example only, as a rotatable head assembly. Drill rod 16 is rotatable with the rotatable head. In one embodiment, the bearing spindle apparatus comprises a radially extending surface portion and a non-metallic seal received thereagainst. For example in the depicted and but one preferred embodiment, male bearing spindle 64 comprises a radially projecting portion 84 having a radially extending surface portion 86. Another non-metallic seal 87 is received against radially extending surface portion 86. Such in the preferred embodiment is depicted as being rectangular in cross-section and received within a mating rectangular groove 88 formed as part of radially extending surface portion 86. An example non-metallic material for seal 87 comprises polytetrafluoroethylene or other polymer.

In one preferred implementation, rotatable head assembly 62 is depicted as comprising a longitudinal first section 90, a longitudinal second section 91, and a longitudinal third section 92. Longitudinal first section 90 and longitudinal second section 91 are diagrammatically shown as bolting relative to one another, as well as longitudinal third section 92 and longitudinal second section 91 bolting relative to one another. A pair of sealed roller bearings 94 is depicted as being received between bearing spindle apparatus 60 and longitudinal first section 90. Also in the depicted example embodiment, rotatable head 62 extends over female spindle receiver 66, with longitudinal first section 90 being rotatably received thereabout as shown. A seal 95 is stationarily received about female spindle receiver 66 and extends to contact with rotating head longitudinal first section 90 forward of bearings 94. A pair of seals 96 is received stationarily about radially extending portion 84 of male bearing spindle 64 and also engages rotatable head longitudinal first section 90.

Rotatable head assembly 62 comprises a portion projecting radially inward that longitudinally bears against and rotates relative to non-metallic seal 87. In the depicted example embodiment, longitudinal second section 91 comprises a radially inward projecting portion 100 which bears against non-metallic seal 87 and rotates relative thereto.

Longitudinal second section 91 is depicted as retaining elastomeric packing material 102 through which rotatable drilling rod 16 can be slidably forced. Longitudinal third section 92 bears against packing material 102, ideally forcing the packing radially inward to a degree tightly against rotatable drill rod 16. Thereby, rotational motion imparted to drill rod 16 through packing 102 imparts rotational motion of rotatable head assembly 62 relative to bearing spindle apparatus 60.

In an earlier head design, neither of seals 76 nor 87 were utilized, and bearing life was less than desired determined to be due to drilling mud from the tailcuttings coming into contact with the bearings past seals 95 and 96.

Figure 8:
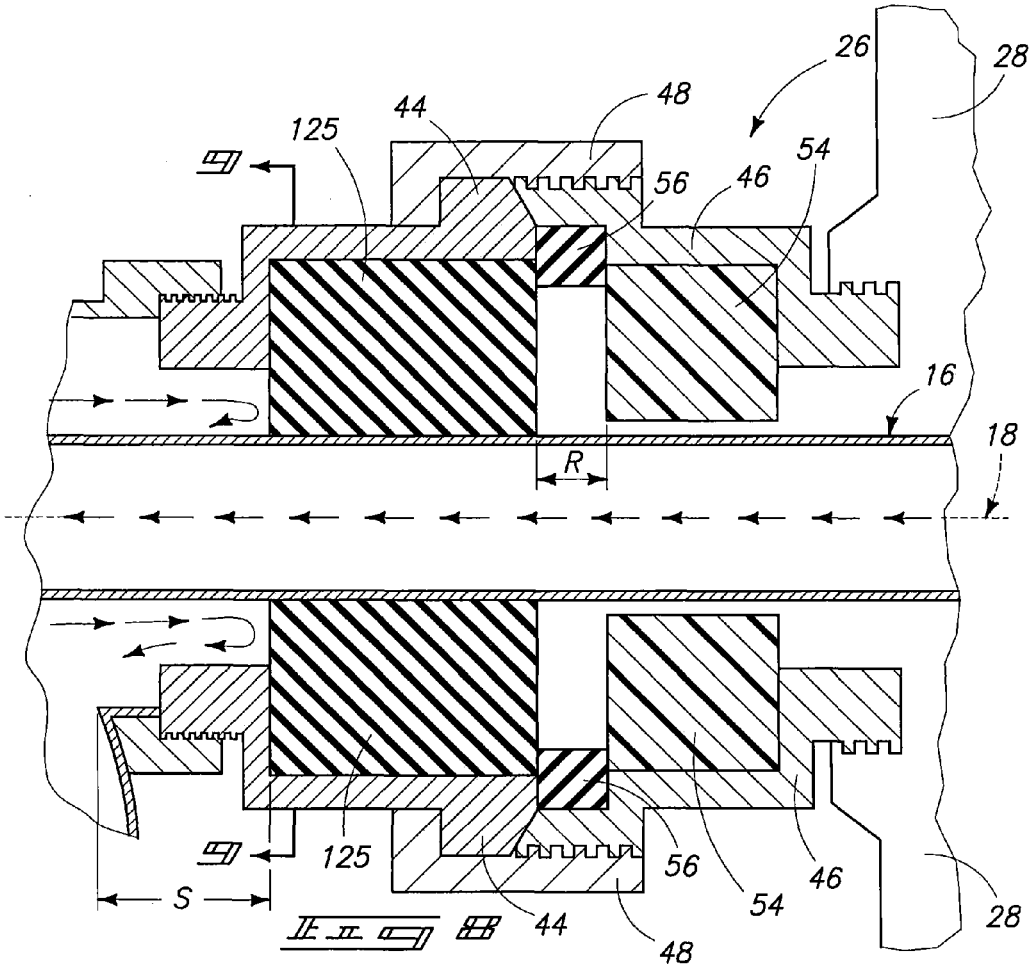
FIG. 8 is an enlarged view of a portion of FIG. 7.
Figure 9:
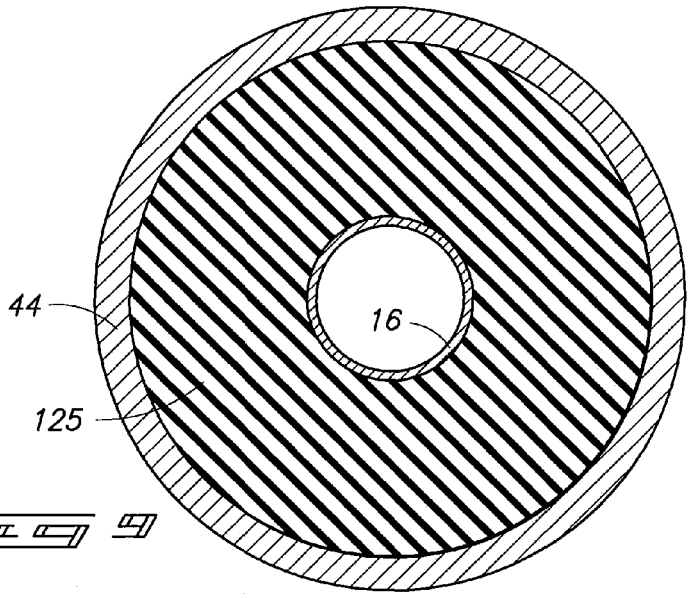
FIG. 9 is a diagrammatic sectional view taken through line 9-9 in FIG. 8.

By way of example only, another example preferred embodiment hydrocarbon recovery drill string apparatus in accordance with multiple aspects of the invention is described in connection with FIGS. 7-9. Like numerals from the first described embodiments have been utilized where appropriate, with differences being indicated with the suffix "a" and with different numerals. Elongated assembly **10*a* comprises a non-rotating non-metallic elastomeric donut portion 125 in place of brush construction 24 (not shown). Elastomeric donut portion 125 is received about and in contact with rotatable drill rod 16 downstream relative to tailcuttings flow of where tailcuttings diverter pipe 33 is received. An example preferred material is an elastomeric neoprene, and may essentially be the same or different from the material from which packing material 102 is made. In one preferred implementation, elastomeric donut portion 125 has at least an initial internal open diameter which is the same as the outer diameter of rotatable drill rod 16. The external diameter of elastomeric donut 125 is ideally sufficiently great to bear against housing 44 to preclude rotation of donut 125 with drill rod 16. In operation, elastomeric donut portion 125 tends to restrict or preclude tailcuttings flow past elastomeric donut portion 125**.

An elastomeric donut portion 125 may only practically be usable at comparatively low rotational speeds of rotatable drill rod 16 in comparison to higher rotational speeds at which a brush construction, such as brush construction 24, might be usable. For example and by way of example only, elastomeric donut portion 125 might be usable where drill rod 16 rotates at from 400 to 500 rpms, but would likely not be capable of use at higher rpms of around 1,800 to 2,000 rpms without significant wear and/or extremely short life. However, a brush construction 24 as described in connection with the first-described embodiment assembly 10 would likely be usable over all ranges of rotation speeds, and particularly at higher rotation speeds than elastomeric donut portion 125 would be usable. Further, both an elastomeric donut portion and a brush construction might be used.

Methodical aspects of the invention include subterranean hydrocarbon recovery drilling methods and subterranean hydrocarbon recovery methods using apparatus as described above, only portions of apparatus as described above, and/or using other apparatus. Accordingly, methodical aspects of the invention are not limited by apparatus limitations unless specifically included in a claim under analysis.

In one embodiment, a subterranean hydrocarbon recovery drilling method includes, within a subterranean room, drilling into a hydrocarbon deposit at an initial angle which is from horizontal to upward vertical using an elongated assembly within which a rotating drill rod is received. Accordingly, the initial angle of the drilling might be at a horizontal angle, at a vertical angle, and at an angle between horizontal and upward vertical, with an initial drilling angle between horizontal and 45° from horizontal being preferred. Regardless, the drill string assembly comprises a longitudinal axis. By way of example only, the hydrocarbon recovery drill string apparatus 10 of FIG. 1 comprises but one example and preferred apparatus, although other apparatus and only certain aspects or portions of the FIG. 1 apparatus might be used.

During the drilling, tailcuttings from the drilling are flowed within the assembly rearwardly along the longitudinal axis.

Flow of the rearwardly flowing tailcuttings is diverted from the longitudinal axis through a diverter pipe having an initial fluid flow path from the longitudinal axis which is acute from the longitudinal axis.

In one embodiment, a subterranean hydrocarbon recovery drilling method includes, within a subterranean room, drilling into a hydrocarbon deposit at an initial angle which is from horizontal to upward vertical using an elongated assembly within which a rotating drill rod is received. Aspects of the above-described method are of course contemplated, and such might be accomplished utilizing the apparatus described herein, only a portion thereof, or other apparatus. Regardless, tailcuttings from the drilling are flowed within the assembly rearwardly along the rotating drill rod. The rotating drill rod is contacted with brush bristles which encircle the rotating drill rod to block at least some of the rearwardly flowing tailcuttings from flowing rearwardly of the brush bristles along the rotating drill rod. In one embodiment, the contacting comprises limiting radial drill rod movement adjacent to brush bristles with a non-metallic drill rod retainer portion encircling the drill rod adjacent the brush bristles, and in one embodiment, with such member being received/positioned downstream relative to tailcuttings flow from the brush bristles.

In one embodiment, the diverted tailcuttings are flowed to above the earth's surface, and at least some solids are separated therefrom to reclaim liquid cutting fluid. At least some of the reclaimed liquid cutting fluid is flowed into the rotating drill rod.

In one embodiment, a subterranean hydrocarbon recovery drilling method includes, within a subterranean room, drilling into a hydrocarbon deposit at an initial angle which is from horizontal to upward vertical using an elongated assembly within which a rotating drill rod is received. Aspects of the above-described methods are of course contemplated, and such might be accomplished utilizing the apparatus described herein, only a portion thereof, or other apparatus. Regardless, tailcuttings from the drilling are flowed within the assembly rearwardly along the rotating drill rod. The rotating drill rod is contacted with a non-rotating non-metallic elastomeric donut portion which encircles and contacts the rotating drill rod to block at least some of the rearwardly flowing tailcuttings from flowing rearwardly of the elastomeric donut portion along the rotating drill rod. In one embodiment, the contacting comprises limiting radial drill rod movement adjacent the elastomeric donut portion with a non-metallic drill rod retainer portion encircling the drill rod adjacent the elastomeric donut portion. In one embodiment, the retainer portion is received downstream relative to tailcuttings flow of the elastomeric donut portion.

Some aspects of the invention also encompass subterranean hydrocarbon recovery methods. For example, in one implementation, and within a subterranean room, drilling is conducted into a hydrocarbon deposit at an initial angle which is from horizontal to upward vertical using an elongated assembly within which a rotating drill rod is received. The assembly comprises a longitudinal axis. Example methods and apparatus in conducting such drilling can be as described above. The drilling forms a well bore that extends into the hydrocarbon deposit from the subterranean room. Tailcuttings are flowed from the drilling within the assembly rearwardly along the longitudinal axis. Flow of the rearwardly flowing tailcuttings is diverted from the longitudinal axis through a diverter pipe having an initial flow path from the longitudinal axis which is acute from the longitudinal axis. Again, method and apparatus as referred to above might be utilized. After the drilling, the drill rod is removed from the well bore, and hydrocarbon is flowed from the deposit into the subterranean room. Of course, likely the entire drilling apparatus is removed with the drill rod.

In one embodiment, a subterranean hydrocarbon recovery method includes, within a subterranean room, drilling into a hydrocarbon deposit at an initial angle which is from horizontal to upward vertical using an elongated assembly within which a rotating drill rod is received. Again, method and apparatus as described above are contemplated in conducting such drilling. The drilling forms a well bore that extends into a hydrocarbon deposit from the subterranean room. Tailcuttings from the drilling are flowed within the assembly rearwardly along the rotating drill rod. The rotating drill rod is contacted with brush bristles which encircle the rotating drill rod to block at least some of the rearwardly flowing tailcuttings from flowing rearwardly of the brush bristles along the rotating drill rod. After the drilling, the drill rod is removed from the well bore and hydrocarbon flows from the deposit into the subterranean room.

In one embodiment, a subterranean hydrocarbon recovery method includes, within a subterranean room, drilling into a hydrocarbon deposit at an initial angle which is from horizontal to upward vertical using an elongated assembly within which a rotating drill rod is received. Again, method and apparatus as described above are contemplated in conducting such drilling. The drilling forms a well bore that extends into a hydrocarbon deposit from the subterranean room. Tailcuttings from the drilling are flowed within the assembly rearwardly along the rotating drill rod. The rotating drill rod is contacted with a non-rotating non-metallic elastomeric donut portion which encircles and contacts the rotating drill rod to block at least some of the rearwardly flowing tailcuttings from flowing rearwardly of the elastomeric donut portion along the rotating drill rod. After the drilling, the drill rod is removed from the well bore and hydrocarbon flows from the deposit into the subterranean room.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A hydrocarbon recovery drill string apparatus, comprising:

an elongated assembly within which a rotatable drill rod is received, the assembly comprising a rotating head apparatus comprising:

a male bearing spindle through which the drill rod is rotatably received, the male bearing spindle comprising threads, the male bearing spindle threads comprising a longitudinal outer surface;

a female spindle receiver through which the drill rod is rotatably received, the female spindle receiver comprising threads which threadedly receive the male bearing spindle threads, the female spindle receiver threads comprising a longitudinal inner surface against which a non-metallic seal is received, the longitudinal outer surface of the male bearing spindle threads bearing against the non-metallic seal; and a rotatable head received rotatably by and about the male bearing spindle, the drill rod being rotatable with the rotatable head.

2. The apparatus of claim 1 wherein the rotatable head extends over the female spindle receiver.

3. The apparatus of claim 1 wherein the non-metallic seal comprises an o-ring.

4. The apparatus of claim 1 wherein the longitudinal inner surface of the female spindle receiver threads comprises a groove within which the non-metallic seal is received.

5. The apparatus of claim 4 wherein the non-metallic seal comprises an o-ring.

6. The apparatus of claim 1 comprising roller bearings received between the male bearing spindle and the rotatable head.

7. The apparatus of claim 1 wherein the male bearing spindle comprises a radially extending surface portion having another non-metallic seal received thereagainst, the rotatable head comprising a portion projecting radially inward that longitudinally bears against and rotates relative to the non-metallic seal that is received against the radially extending surface portion.

8. A hydrocarbon recovery drill string apparatus, comprising:

an elongated assembly within which a rotatable drill rod is received, the elongated assembly comprising a rotating head apparatus comprising:

a bearing spindle apparatus through which the drill rod is rotatably received, the bearing spindle apparatus comprising a radially extending surface portion, a non-metallic seal received against the radially extending surface portion; and a rotatable head assembly received by and about the bearing spindle apparatus, the rotatable head assembly comprising a portion projecting radially inward that longitudinally bears against and rotates relative to the non-metallic seal, the drill rod being rotatable with the rotatable head.

9. The apparatus of claim 8 wherein the rotatable head assembly comprises a longitudinal first section and a longitudinal second section which bolt relative to one another, roller bearings being received between the bearing spindle apparatus and the longitudinal first section, the radially inward projecting portion comprising part of the longitudinal second section.

10. The apparatus of claim 9 comprising packing received by the longitudinal second section and through which the drill rod is slidably received.

11. The apparatus of claim 10 wherein the rotatable head assembly comprises a longitudinal third section which bolts relative to the longitudinal second section and bears against the packing.

* * * * *